US006760932B1

(12) United States Patent
Maiuccoro

(10) Patent No.: US 6,760,932 B1
(45) **Date of Patent: *Jul. 13, 2004**

(54) HYDROTHERAPY TUB COPLANAR FLOW

(75) Inventor: John V. Maiuccoro, Albany, NY (US)

(73) Assignee: Saratoga Spa & Bath, Inc., Latham, NY (US)

( * ) Notice: Subject to any disclaimer, the term of this patent is extended or adjusted under 35 U.S.C. 154(b) by 374 days.

This patent is subject to a terminal disclaimer.

(21) Appl. No.: 10/010,337

(22) Filed: Oct. 22, 2001

Related U.S. Application Data

(63) Continuation of application No. 09/253,476, filed on Feb. 19, 1999, now Pat. No. 6,351,859, which is a continuation-in-part of application No. 08/914,645, filed on Aug. 19, 1997, now abandoned.

(51) Int. Cl.[7] ..... A61H 33/02
(52) U.S. Cl. ..... 4/541.4
(58) Field of Search ..... 4/541.4, 541.6, 4/591, 678; 239/428.5, 432, 568, 597; 261/DIG. 75

(56) References Cited

U.S. PATENT DOCUMENTS

| | | | | |
|---|---|---|---|---|
| 469,211 A | | 2/1892 | Kline | 239/568 |
| 493,194 A | | 3/1893 | Stifel et al. | 4/591 |
| 745,518 A | | 12/1903 | Pettengill | 239/597 X |
| 1,511,118 A | | 10/1924 | Fiduccia, Sr. | 239/597 X |
| 1,512,193 A | | 10/1924 | Berven | 4/591 |
| 1,769,178 A | | 7/1930 | Delany | 239/456 |
| 1,772,426 A | | 8/1930 | McConnell et al. | 239/432 X |
| 2,336,127 A | | 12/1943 | Rocke | 4/541.4 X |
| 2,714,725 A | | 8/1955 | Boone | 4/569 |
| 3,587,976 A | | 6/1971 | Jacuzzi | 239/428.5 X |
| 4,520,514 A | | 6/1985 | Johnson | 4/490 |
| 4,546,505 A | | 10/1985 | Wakenshaw | 4/541.3 X |
| 4,563,782 A | | 1/1986 | Dijkhuizen | 4/541.4 |
| 4,896,384 A | | 1/1990 | Dijkhuizen | 4/541.6 |
| 4,953,240 A | | 9/1990 | Gardenier | 4/541.3 |
| 5,063,620 A | | 11/1991 | Mersmann | 4/541.6 |
| 5,418,984 A | | 5/1995 | Livingston, Jr. | 4/541.1 |
| 5,514,267 A | * | 5/1996 | Machiya et al. | 261/DIG. 75 |
| 5,546,616 A | | 8/1996 | Bloemer et al. | 4/541.2 |
| 6,351,859 B1 | * | 3/2002 | Maiuccoro | 4/541.4 |

* cited by examiner

*Primary Examiner*—Robert M. Fetsuga
(74) *Attorney, Agent, or Firm*—Heslin Rothenberg Farley & Mesiti P.C.; Nicholas Mesiti, Esq.; Victor A. Cardona, Esq.

(57) ABSTRACT

Hydrotherapy-tub coplanar-flow device includes slotted nozzle on a body for discharge of fluids from the nozzle in a substantially coplanar flow. The body is adapted for mounting on an inner surface of a hydrotherapy tub and attachable to first and second fluid supply conduits. Further, the body has a first inlet for flow of water from the first fluid supply conduit and a second inlet for flow of air from the second fluid supply conduit. The slotted nozzle discharges these fluids in the substantially coplanar flow. The second inlet of the body is located between the first inlet and the slotted nozzle. The body includes an air dam located between the inlets, such as an interior face portion having a steep decline toward the second inlet of the body.

9 Claims, 6 Drawing Sheets

HYDROTHERAPY TUB COPLANAR FLOW

This application is a Continuation of U.S. patent application Ser. No. 09/253,476, filed Feb. 19, 1999, U.S. Pat. No. 6,351,859 which is a Continuation-In-Part of U.S. patent application Ser. No. 08/914,645, filed Aug. 19, 1997, abandoned. The priorities of both applications are claimed herein, and the entire disclosures of both are incorporated herein by reference.

TECHNICAL FIELD

This invention relates, in general, to hydrotherapy tubs and, in particular, to coplanar flow nozzles usable for creating fluid flow in hydrotherapy tubs.

BACKGROUND ART

Hydrotherapy tubs generally have a number of fluid flow outlets or nozzles. Each flow nozzle usually jets water or a water-air froth into the tub. Enhanced hydrotherapy typically results from strategic positioning of these fluid flow nozzles at various locations in the tub.

One design delivers water to a fixed rectangular spout and subsequently through a wider rectangular outlet for mixing with air and coplanar expulsion along the tub inner surface. An air jacket or shell, extending over the rectangular spout and forming the subsequent outlet, uses the pressure drop caused by the spouted water to draw in the atmospheric air along a path above the water line from a rearward opening within the shell. Such a configuration is disclosed in U.S. Pat. No. 4,953,240 to Gardenier. However, in this coplanar nozzle, there is no separate or isolated conduit for supplying air from underneath the tub surface. Therefore, this type of coplanar-flow nozzle cannot be positioned below the tub water line to produce an air-water mixture or froth. In addition, it remains desirable to provide improvements for the air and/or water flow provided by this type of coplanar-flow nozzle, to enhance the resultant air-water mixture, efficiency, and/or hydrotherapeutic effectiveness.

Thus, a need exists for a hydrotherapy tub and a coplanar nozzle therefor having improved delivery of multiple fluids so that coplanar flow of an air-water froth may occur below the water line. A further need exists for enhanced strategic directioning of the air and water flow paths in providing the air-water mixture or froth. Also, a need exists for a coplanar nozzle forming a water flow path which enhances efficiency and/or effectiveness in drawing air flow to produce a hydrotherapeutic airwater mixture, so that no external pressure source such as a pump is needed to pump air for mixture with water to create a froth.

SUMMARY OF THE INVENTION

The shortcomings of the prior art are overcome and additional advantages are provided through an improved hydrotherapy-tub coplanar-flow device.

The coplanar flow device includes a body having first and second inlets and a slotted outlet or nozzle. The first inlet provides flow of a first fluid, namely water. Further, the second inlet provides flow of a second fluid, namely air. The first and second fluids can be provided from respective first and second fluid supply conduits. The slotted nozzle discharges these fluids in a substantially coplanar flow. The present invention desirably improves hydrotherapy by merging the fluids (e.g., air and water) from the first and second inlets for discharge in the substantially coplanar flow. The second inlet of the body is located between the first inlet and the slotted nozzle. In addition, the body includes an air dam such as an interior face portion having a steep decline toward the second inlet. The steep decline of the interior face portion of the body, is located between the first and second inlets.

In another embodiment of the present invention, the device is mounted on an inner surface of a hydrotherapy tub. Through a slotted nozzle, the fluid is discharged in a substantially coplanar flow on the inner surface of the hydrotherapy tub.

Additional features and advantages are realized through the structures and techniques of the present invention. Other embodiments and aspects of the invention are described in detail herein.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be apparent from the following detailed description of preferred embodiments taken in conjunction with the accompanying drawings in which:

DESCRIPTION OF THE PREFERRED EMBODIMENTS

In accordance with the principles of the present invention, coplanar flow capability is provided for a hydrotherapy-tub by using a coplanar-flow device in which flow channels merge fluids (e.g., air and water) for discharge from a nozzle in a substantially coplanar flow, as described below.

Figure 1:
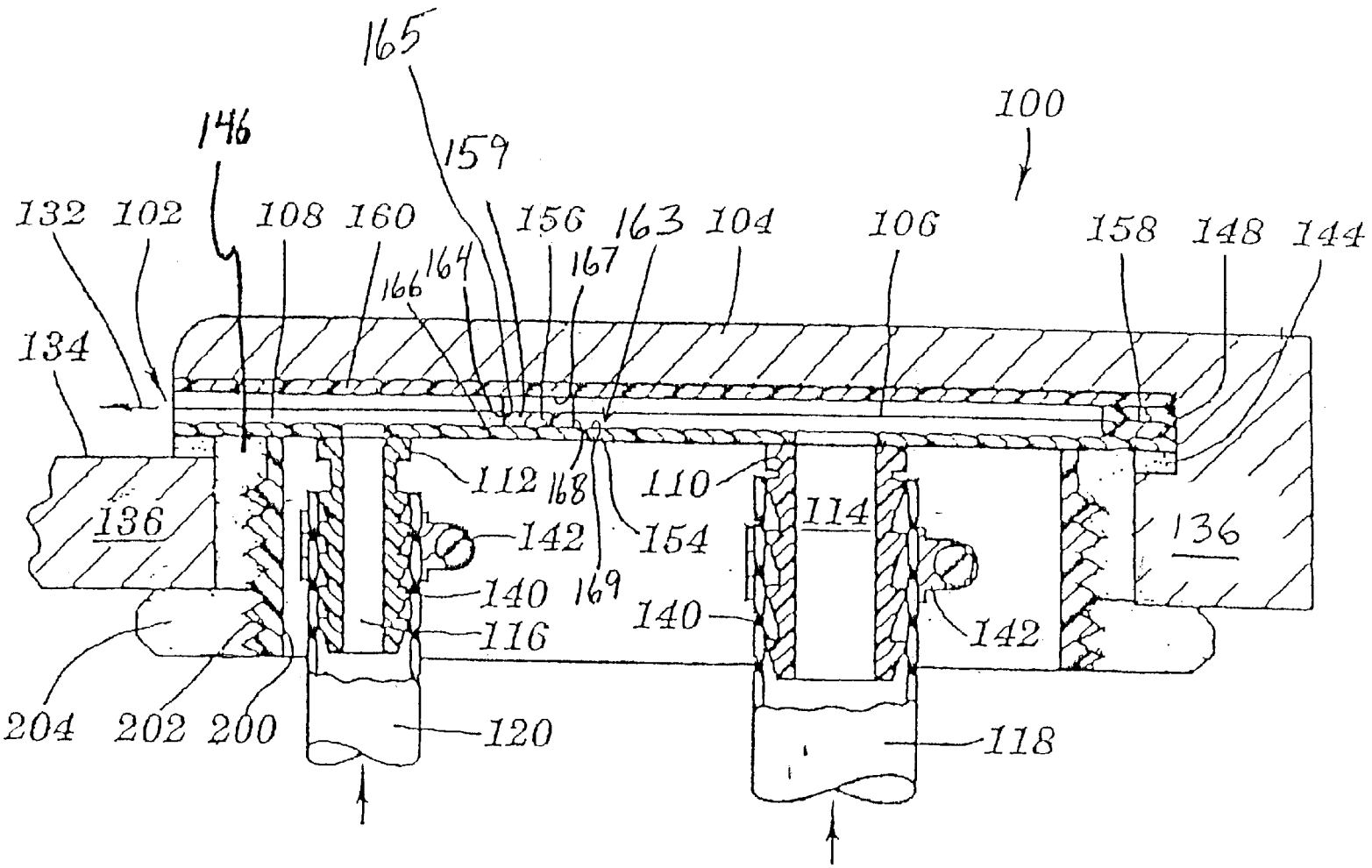
FIG. 1 is a side sectional view of one example of a hydrotherapy-tub coplanar-flow device producing substantially coplanar flow in accordance with the principles of the present invention and mounted within a hydrotherapy tub.

One example of a hydrotherapy-tub coplanar-flow device incorporating and using the novel features of the present invention is depicted in FIG. 1 and described in detail herein.

In this exemplary embodiment, a coplanar flow device 100 may be mounted onto a hydrotherapy tub 136 so that a slotted outlet or nozzle 102 on body 104 is exposed to the interior of the tub. The coplanar flow device is oriented so that the nozzle allows a water and air mixture (e.g., froth) to flow substantially coplanar from the slotted outlet along an inner surface 134 of the hydrotherapy tub.

Nozzle 102 is in fluid flow communication with flow channels 106 and 108. Through openings 114 and 116 in the body 104, inlets 110 and 112 feed fluids (e.g., water and air) from the fluid supply conduits 118 and 120. For example, water from fluid supply conduit 118 may enter into inlet 110 and flow through flow channel 106. Further, air from fluid supply conduit 120 may enter into inlet 112 and flow through flow channel 108. The water in flow channel 106 and air in flow channel 108 are advantageously mixed and ejected out of the nozzle in a coplanar flow 131 (FIG. 3) in relative direction 132 over inner surface 134 of hydrotherapy tub 136.

Figure 3:
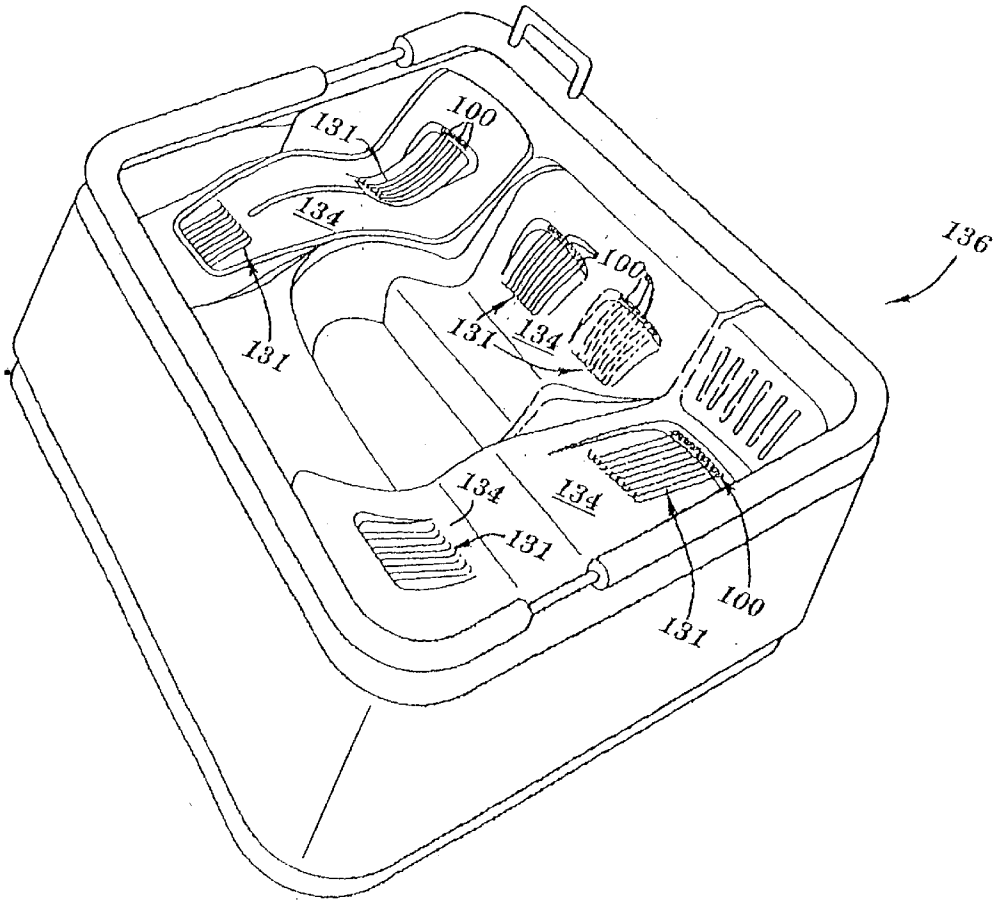
FIG. 3 is a perspective view of one embodiment of a hydrotherapy tub with multiple hydrotherapy-tub coplanar-flow devices, in accordance with the principles of the present invention.

Preferably, flow channel 106 contains water delivered through fluid supply conduit 118 under pressure. The water flow transition from fluid supply conduit 118, through inlet 110, and into flow channel 106 for eventual discharge from nozzle 102 may advantageously serve to promote air delivery from fluid supply conduit 120 and into substantially coplanar flow 131 (FIG. 3). A decreased cross-sectional area for flow of the pressurized water formed by dam 159 yields increased flow velocity of the water as it passes opening 116 for inlet 112, which introduces air into body 104. This increased stream velocity of the water allows air at opening 116 to be drawn through the inlet 112 to form the substantially coplanar flow. In addition, the drawing of air is promoted by a separation distance between the pressurized water, and the opening 116 of the inlet 112, whose air flow is advantageously influenced and/or promoted by the presence of an air dam which may be formed from a protuberance 159 on interior face portion 163 of body 104, as described herein. With such a configuration, a sufficient mixture of water and air may be created so that the coplanar flow of the froth is strong enough to provide sufficient hydrotherapy effects, without the use of air pumps for the air.

Further, air may be desirably delivered to body 104 from below the water line. By designing device 100 to increase the water velocity for drawing air through opening 116, fluid supply conduit 120 may extend below the water line to, for instance, an atmospheric air source having any desired location. For example, the air source could be a valve or hole exposed to the atmosphere from any desired location on hydrotherapy tub 136, whether above or below a given water line. The valve would allow the user to selectively control the amount of air finally ejected into substantially coplanar flow 131 (FIG. 3), for improved hydrotherapy.

Figure 2:
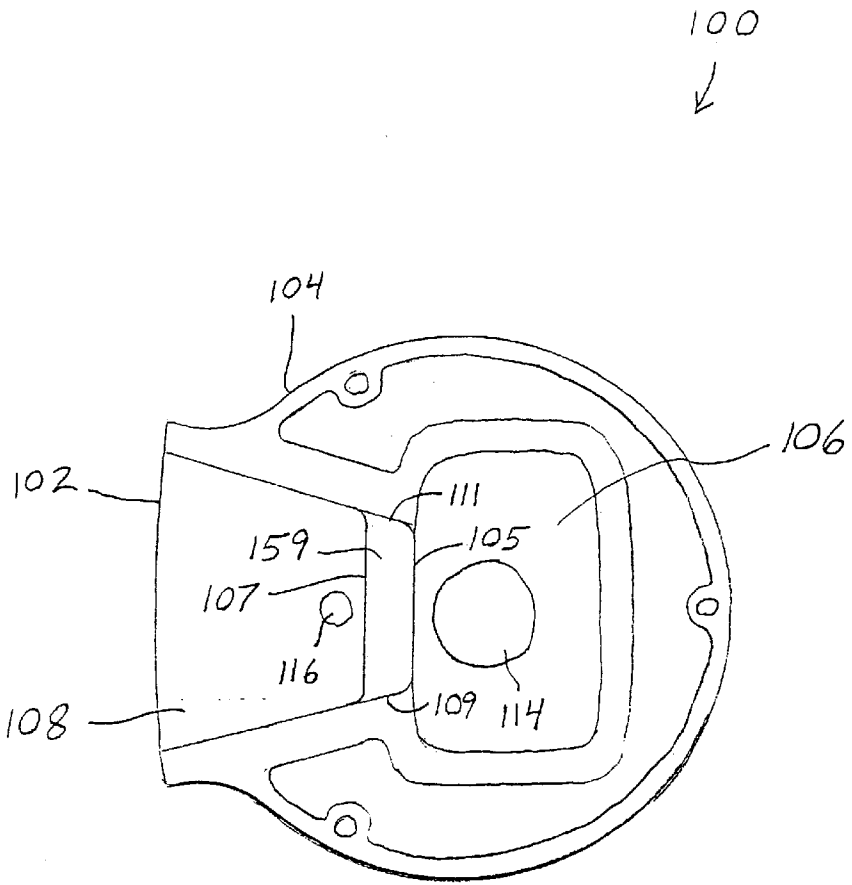
FIG. 2 is a top, sectional, cutaway view of another example of a hydrotherapy-tub coplanar-flow device in accordance with the principles of the present invention.

In one example, the interior face portion 163 of body 104 includes the air dam 159 for enhanced fluid flow, pressure, and/or dynamics, as can be appreciated through examination of FIGS. 1–3 in conjunction with the description herein. For instance, the air dam 159 may be formed with a protuberance (e.g., a step, stop, and/or other structure which creates a reduction of the cross-sectional area through which flows the water) that may include a steep decline 164, for example, facing and/or leading toward inlet 112. The steep decline may comprise an abrupt transition from a land 165 of the protuberance, toward the inlet 112. For example, the abrupt transition may occur between the land 165 and a region 166 of the interior face portion 163, with the region 166 located between the protuberance and the inlet 112. Such a configuration may advantageously cause flow of water from fluid supply conduit 118, to have a separation distance over the inlet 112, for example, to promote drawing of air from the inlet 112 to substantially coplanar flow 131.

As will be understood by those skilled in the art, body 104 with protuberance 159 as an air dam may be configured to cause flow of water from fluid supply conduit 118 to form a low pressure between inlet 112 and the water flowing thereabove from fluid supply 118. That is, the steep decline 164 may serve to cause the flow of water from the fluid supply conduit 118 to have the separation distance over the second inlet 112, to form the low pressure over and/or about the second inlet, and/or the region 166 of the interior face portion 163. This low pressure may advantageously serve as an original and/or added motivation for air to leave a relatively higher pressure in the fluid supply conduit 120, and enter the flow channel 108 in body 104. This region 166 and/or protuberance 159 may have any desired size and/or configuration. For example, it may be desirable to increase or decrease the size of the region 166 and/or protuberance 159, to suit and/or achieve certain flow characteristics and/or mixture composition, such as by increasing and/or decreasing the volume and/or extent between flow channel 106 and inlet 112 (e.g., a section of the flow channel 108).

Body 104 may be formed, for instance, so that the ratio of the cross-sectional flow area at the water supply inlet 110 to the cross-sectional flow area over the air dam 159 is approximately 1.7 or higher. The cross-sectional area of the inlet 110 may be a passage area (e.g., a circle characterized by an inner diameter) of inlet 110. The cross-sectional area of the available flow area over the air dam may be defined by the product of the distance from protuberance 159 (e.g., land 165) to an opposing interior face portion 167, and the length (e.g., or average length) of sides 105, 107 (see FIG. 2). Additional description of FIG. 2 is presented herein.

One or more benefits, features, advantages, constructions, and/or enhancements analogous to those described herein with reference to protuberance 159 (e.g., for device 100, FIGS. 1–3) may be provided with one or more of protuberances 159" (e.g., for device 100", FIG. 4) and/or 159'" (e.g., for device 100'", FIGS. 5–6), as will be appreciated by those skilled in the art. Moreover, any appropriate relative location among various components and/or formations (e.g., inlet 110, inlet 112, protuberance 159, and/or nozzle 102), may be selected and/or formed for a particular device of the invention. Further, a certain device (e.g., devices 100, 100", and/or 100'") of the invention may have any number, type, and/or combination of protuberances (e.g., protuberances 159, FIGS. 1–3, 159", FIG. 4, and/or 159'", FIGS. 5–6).

Again referring to FIG. 1, in addition to steep decline 164, protuberance 159 may include an abrupt step or steep transition (e.g., incline) 168 from a region 169 to land 165 of the protuberance. That is, the steep transition 168 and the region 169 may be located between the protuberance 159 and inlet 110. In guiding and/or directing flow of water from the inlet 110 to have the separation distance over inlet 112 at termination of the protuberance, the steep transition 168 at initiation of the protuberance may, for instance, desirably cause a high pressure over and/or above the region 169. Various aspects of the invention related to such flow features, system dynamics, and/or hydrodynamics, will be appreciated by those skilled in the art.

Referring still to FIG. 1, in one embodiment of device 100 for hydrotherapy tub 136, water may be pressurized and air may flow from atmosphere pressure so as to be mixed within coplanar flow device 100 for ejection out of nozzle 102. In another embodiment, both water in fluid supply conduit 118 and also air in fluid supply conduit 120 may be supplied under pressure. Additional description of exemplary air and water flow is presented further below.

For illustrative purposes, the following exemplary dimensions for device 100 are presented. Referring to FIG. 1, inlet 110 may have an inner diameter in the approximate range of 13–15 mm. Inlet 112 may have an inner diameter in the approximate range of 4–6 mm. Referring to FIG. 2, side 105 of air dam 159 may have a length in the approximate range 20–22 mm. Side 107 of the air dam may have a length in the approximate range 22–24 mm. Sides 109, 111 may each have a length in the approximate range 6–8 mm. Again referring to FIG. 1, body 104 may have a distance from the center of the inlet 110 to steep transition 168 of the air dam, in the approximate range 9–11 mm. The body may have a distance from the center of the inlet 112 to steep decline 164 of the air dam, in the approximate range 4–6 mm.

Referring to FIG. 1 for explanatory purposes, water is delivered from fluid supply conduit 118, through inlet 110, and into flow channel 106. For water transmission, the fluid supply conduit 118 would be a typical hose or tube leading from a (e.g., 13–14 p.s.i.) pump (not shown) housed within or nearby hydrotherapy tub 136. The pump would provide sufficient pressure for the formation of coplanar flow 131 (FIG. 3). For example., the pump may provide a water flow of 13 g.p.m. The pump typically would receive the water from within the tub and recirculate the same into the tub after pumping the water through one or more coplanar-flow devices 100. Furthermore, the user may advantageously adjust the pressure and/or amount of water delivered through fluid supply conduit 118, inlet 110, and flow channel 106. As will be understood by those skilled in the art, various devices may be used for flow adjustment and controls therefor may appear in various locations.

Air may be delivered from fluid supply conduit 120, through inlet 112, and into flow channel 108. In one example, the air is supplied below the water line yet vented or ducted from an opening to the atmosphere. As described herein, body 104 may be formed so water from inlet 110 and fluid supply conduit 118, is guided and/or directed by protuberance 159 to flow a separation distance over inlet 112, and promote and/or enhance drawing of air into the inlet 112 from the fluid supply conduit 120. This provides an efficient and/or effective system for delivering (e.g., hydrotherapeutically) desirable relative amounts of water and air to the substantially coplanar flow 131.

For transmission of the air in another example, fluid supply conduit 120 would be a typical hose or tube leading from a compressor or air pump (not shown) housed within or nearby the hydrotherapy tub. The compressor or air pump would contribute adequate pressure to provide desirable characteristics of the substantially coplanar flow. Ambient air vented from an outer surface of the hydrotherapy tub could be fed to the compressor or air pump. As with the water supply line described above, the air supply line desirably may allow the user to adjust the pressure and/or amount of air delivered through fluid supply conduit 120, inlet 112, and flow channel 108.

By allowing the user to adjust the flow characteristics in one or more of the various fluid supply lines as desired in conjunction with the configuration of flow paths in body 104, the present invention advantageously permits the user to select mixtures and/or delivery rates of fluids such as air and water, for improved hydrotherapy through control over the coplanar fluid flow.

In accordance with the present invention, the hydrotherapy-tub coplanar-flow device may be mounted on the hydrotherapy tub in a variety of ways. FIG. 1 depicts the body of the coplanar-flow device largely embedded within the hydrotherapy tub wall. In this particular recess, the coplanar-flow device top is entirely covered by the tub inner surface. The nozzle peeks out from under this inner surface to desirably aim along relative direction 132, approximately parallel to the inner surface.

In a further example, referring to FIG. 1, coil clamps 142 may be used to secure fluid supply conduits 118 and 120 to respective inlets 110 and 112. Also, epoxy and/or glue may be employed.

In particular, inlets 110 and 112 maintain secure fluid communication with respective fluid supply conduits 118 and 120. For example, each inlet 110, 112 may possess a number of integrally formed barbs 140. Upon sliding insertion of each inlet into one of the fluid supply conduits, the barbs provide local points of highly increased static friction. Further, one may tighten clamps 142 around the fluid supply conduits at a location encircling the barbs in order to strengthen attachment of the inlets and fluid supply conduits. These measures yield securely sealed communication of fluid from fluid supply conduit 118 through inlet 110. Additionally, fluid securely flows from fluid supply conduit 120 through inlet 112.

Furthermore, coplanar-flow device 100 may include sidewalls 200 surrounding inlets 110 and 112. For instance, the sidewalls may include exterior threads 202 for mating with nut 204 in order to securely position the device at local inner surface 134 of the tub 136.

In one example, the device 100 is mounted to the inner surface 134 of hydrotherapy tub 136 using epoxy or a similar water-tight sealant 144. The epoxy forms a fluid-tight seal that safeguards the contents of the hydrotherapy tub. In one preferred embodiment, the epoxy affixes body 104 in a position over chamber 146 that extends through part of the tub inner surface. The body, epoxy, and chamber cooperate to further provide a safe housing, for the secure fastening of inlets 110 and 112 to respective fluid supply conduits 118 and 120. The body 104 may be affixed in recess 148 of tub inner surface 134.

In one embodiment, the various components, layers, or parts of coplanar-flow device 100 are molded of ABS plastic. As one example, any number of parts of the coplanar-flow device may be injection-molded. For instance, any number of the parts of the coplanar-flow device may be unitary and/or integral. In one example, inlets 110 and 112 and/or sidewalls 200 with threads 202 may be unitary and/or integral with body 104, such as may be done by injection molding. As another example, one may selectively secure the device parts by techniques such as heating or gluing. For instance, layers/plates/portions 154, 156, 158, and 160 could be heated along certain interfaces.

As depicted in FIG. 3, a hydrotherapy tub 136 may be equipped with multiple cooperating instances of hydrotherapy-tub coplanar-flow devices (e.g. such as device 100), in accordance with the present invention. As mentioned above, the slotted outlet or nozzle 102 (FIG. 1) advantageously provides substantially coplanar flow 131 relative to the local inner surface 134. Moreover, the locations of the nozzles participate with local contours of the inner surface to deliver hydrotherapy to the user.

For instance, several of the coplanar-flow devices may be positioned in parallel in order to advantageously provide the coplanar flow 131 in the form of overall sheets of injected fluid. The tub contours already anticipate and promote desirable postures of users in seated and reclined positions. The coplanar-flow devices further promote hydrotherapy by extending the coplanar flow between the tub inner surface 134 and along the outer skin of the user for massaging.

For example, the coplanar-flow devices may advantageously deliver the hydrotherapy coplanar flow 131 between the shoulder blades and down along the back of a user. Also, the coplanar-flow may be directed upward from the feet and ankles and along the calves of a user. Additionally, one may direct the coplanar-flow along the buttocks and hamstrings. Naturally, the coplanar flow will ride along and hug around the exposed skin surfaces of the user. This is fully intended and enhanced, to massage greater extents of key body regions of the user by directing the coplanar flow along the inner surface 134 of tub 136, in accordance with the present invention.

As will be understood by those skilled in the art, benefits result from the positioning of flow channel 106 adjacent to flow channel 108 in device 100 (FIG. 1). Added benefits result from the presence of protuberance 159 in device 100, as discussed above. Also, the hydrotherapy-tub coplanar-flow device 100 may improve hydrotherapy flow at various locations within the hydrotherapy tub 136.

Figure 4:
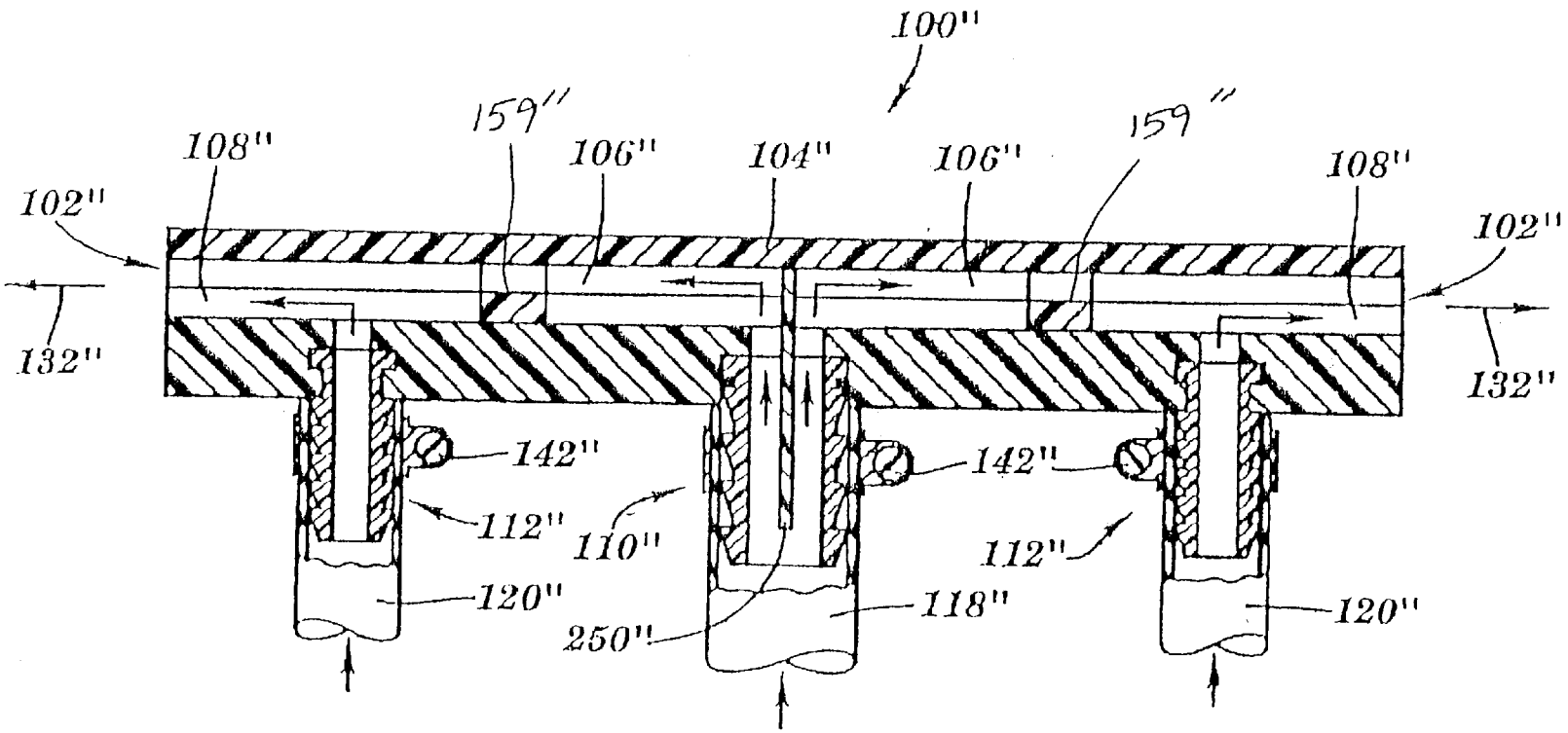
FIG. 4 is an elevation, sectional view of yet another example of a hydrotherapy-tub coplanar-flow device producing substantially coplanar flow in accordance with the principles of the present invention and mounted within a hydrotherapy tub.

As depicted in FIG. 4, another embodiment of the present invention includes dual fluid supply conduits 120" and split fluid supply conduit 118" for servicing dual slotted nozzles 102". In particular, partition or baffle 250" separates or divides fluid delivered from conduit 118" for flow through inlet 110" and dual flow passages 106". Furthermore, the dual slotted nozzles deliver dual, substantially coplanar flows 131 (FIG. 3), for instance, in opposing directions 132".

Figure 5:
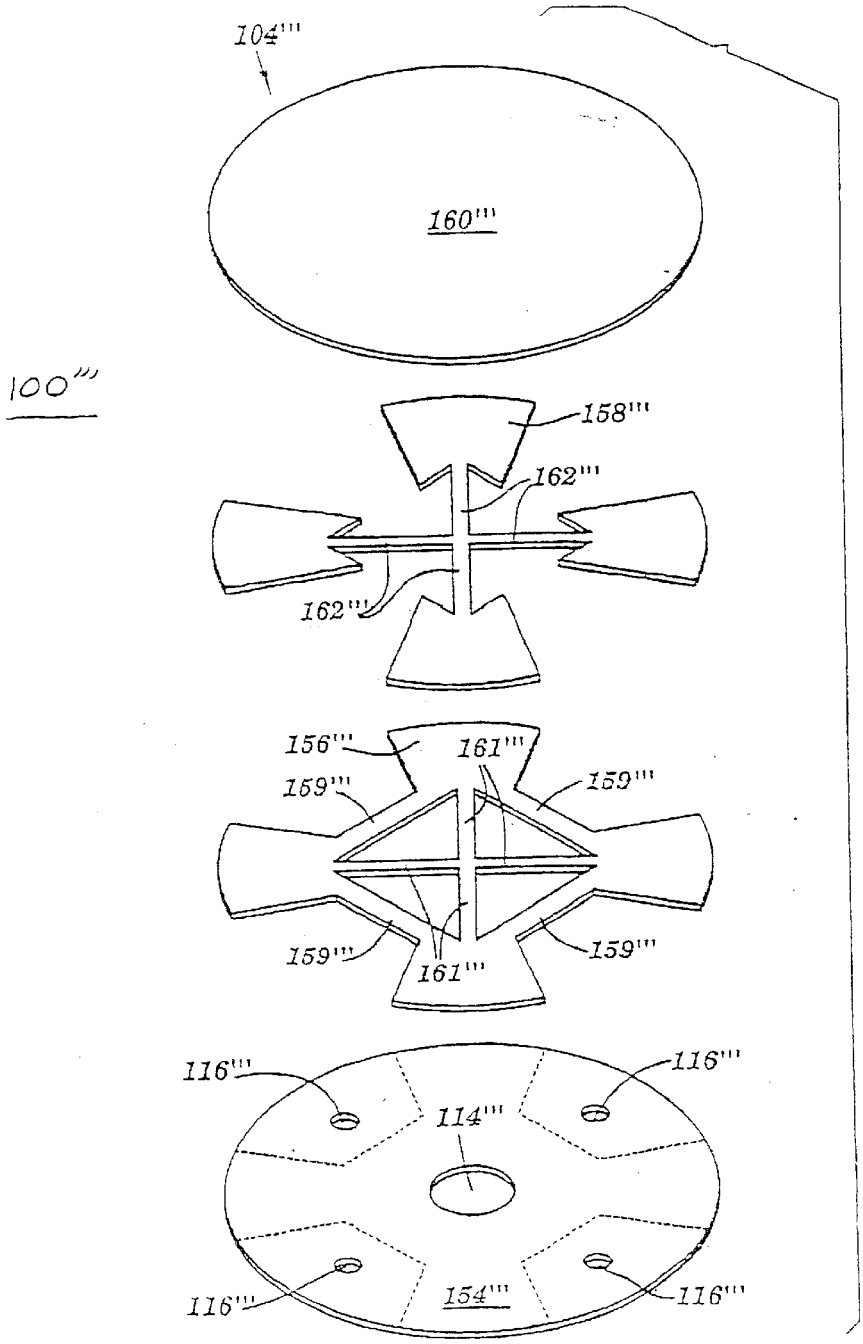
FIG. 5 is an exploded view of a number of components of a further example of a hydrotherapy-tub coplanar-flow device in accordance with the principles of the present invention.
Figure 6:
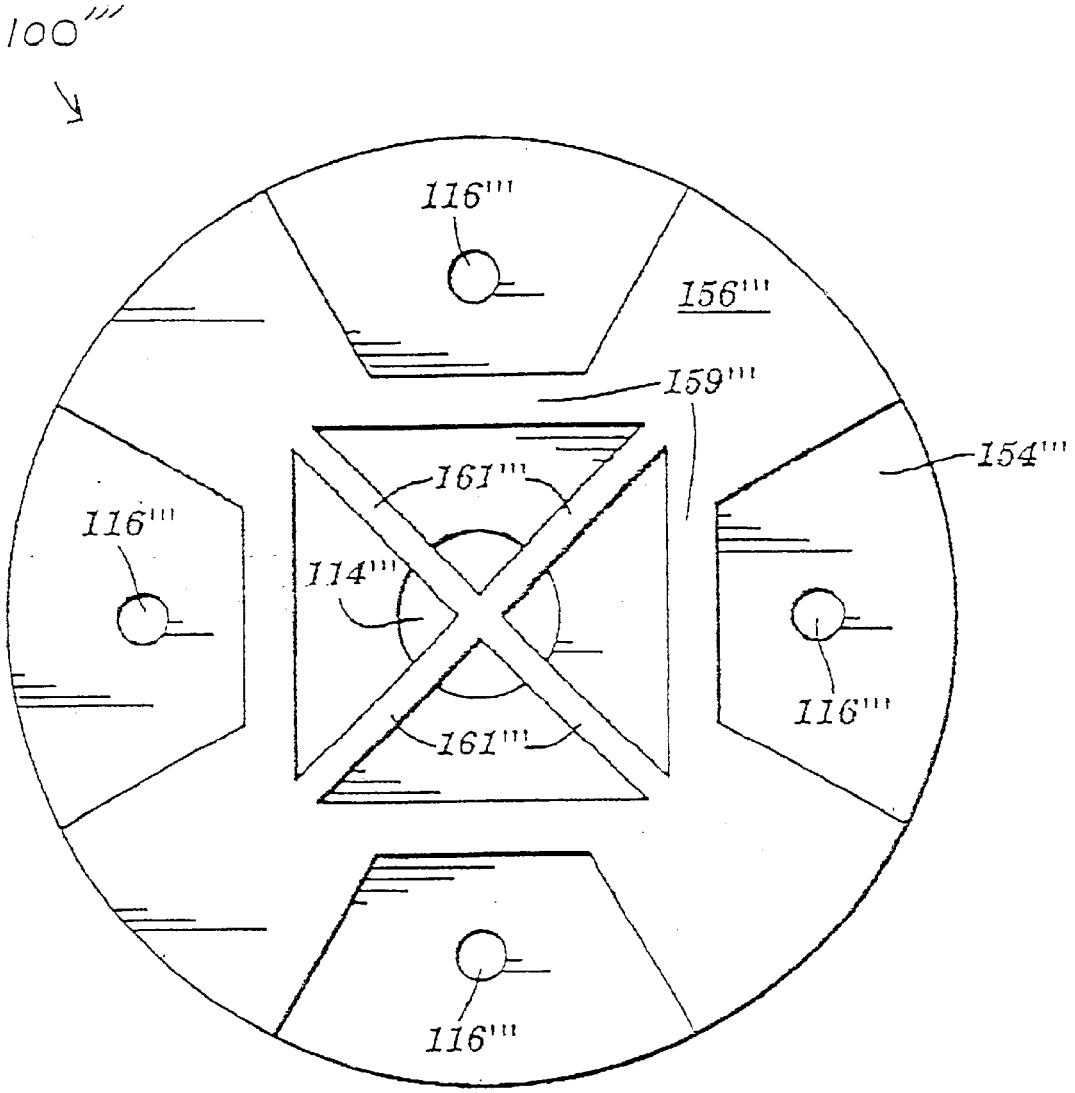
FIG. 6 is a top view of a subset of the components of FIG. 5.

As depicted in FIGS. 5–6, yet another embodiment of the present invention includes four openings 116'" and one opening 114'", split four ways by cooperating cross members 161'" and 162'" of respective intermediate plates 156'" and 158'". As will be understood by those skilled in the art, the resulting nozzle (not shown) would advantageously deliver four substantially coplanar flows 131 (FIG. 3) in four directions, for example, each offset by ninety degrees.

While part(s) of the description herein, for explanatory purposes, may imply certain exemplary direction(s), such direction(s) may be considered relative. For example, a "decline" of protuberance 159 may be provided relative to a local structure, yet present little or no "descending" component in a larger context. In another example, such a "decline" of the protuberance 159 may indeed correspond to an "absolute descent." Design choice(s) allow accommodation(s) of any orientation(s) for any device(s) in accordance with the principles of the present invention.

Numerous alternative embodiments of the present invention exist. For instance, threaded interconnections could easily mount body 104 on inner surface 134, fasten inlets 110, 112 to fluid supply conduits 118, 120, or interconnect any upper and lower plates of body 104. Further, the fluids could easily be liquid or gas. Moreover, each fluid could easily include a group of fluids. Also, more than two fluids could easily be merged into substantially coplanar flow 131. For example, channels 106, 108 could easily take on any variety of interrelationships, ranging from maximal to minimal fluid intermixing or other combination. Additionally, any number of the devices (e.g., device 100") could easily be secured by mechanisms such as sidewalls 200 with mating threads 202 and nut 204. Furthermore, device 100 could easily be fixed in any desired direction 132 relative to a given incline of the inner surface 134.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A hydrotherapy-tub coplanar-flow device, comprising:

a body adapted for mounting on an inner surface of a hydrotherapy tub and attachable to first and second fluid supply conduits, said body having an interior channel, said interior channel having a first inlet for flow of water from said first fluid supply conduit, a second inlet for flow of air from said second fluid supply conduit, and a slotted nozzle configured to discharge said air and water in a substantially coplanar flow on said inner surface;

said second inlet located on said interior channel between said first inlet and said slotted nozzle; and said interior channel further including an interior dam located between said first and second inlets, said dam forming a reduced cross-section area of said interior channel, the cross-sectional area of said interior channel then being increased between said dam and said second inlet.

2. The device of claim 1, wherein said dam is configured to cause water from said first inlet to flow over said second inlet to draw said air from said second inlet to create a water and air froth which exits said slotted nozzle in said substantially coplanar flow.

3. The device of claim 1, wherein said dam comprises a steep decline toward said second inlet.

4. The device of claim 1, wherein said dam comprises at least one abrupt step.

5. The tub of claim 1, wherein said interior dam extends between at least two different surfaces of said interior channel.

6. A hydrotherapy tub, comprising:

an inner surface; and at least one coplanar-flow device, comprising:

a body adapted for mounting on said inner surface and attachable to first and second fluid supply conduits, said body having an interior channel, said interior channel having a first inlet for flow of water from said first fluid supply conduit, a second inlet for flow of air from said second fluid supply conduit, and a slotted nozzle configured to discharge said air and water in a substantially coplanar flow on said inner surface;

said second inlet located, on said interior channel between said first inlet and said slotted nozzle; and said interior channel further including an interior dam located between said first and second inlets, said dam forming a reduced cross-sectional area of said interior channel, the cross-sectional area of said interior channel then increasing between said dam and said second inlet.

7. The tub of claim 6, wherein said interior dam comprises a steep decline located between said first and second inlets.

8. The tub of claim 6, wherein said steep decline is configured to cause flow of water to draw air from said second inlet to create a water and air froth which exits said slotted nozzle in said substantially coplanar flow.

9. The tub of claim 6, wherein said interior dam extends between at least two different surfaces of said interior channel.

* * * * *